US006998786B2

(12) United States Patent
Chiou

(10) Patent No.: US 6,998,786 B2
(45) Date of Patent: Feb. 14, 2006

(54) CONTROL CIRCUIT OF ELECTRONIC BALLAST FOR FLUORESCENT LAMP

(76) Inventor: Yih-Fang Chiou, 1F, No. 132, Lane 39, Sec. 1, Shih-Pai Road, Pei-Tou Dist., Taipei (TW)

( * ) Notice: Subject to any disclaimer, the term of this patent is extended or adjusted under 35 U.S.C. 154(b) by 31 days.

(21) Appl. No.: 10/772,933

(22) Filed: Feb. 4, 2004

(65) Prior Publication Data

US 2005/0168161 A1 Aug. 4, 2005

(51) Int. Cl.
*H05B 37/00* (2006.01)

(52) U.S. Cl. ..... 315/119; 315/127; 315/225; 315/DIG. 7

(58) Field of Classification Search ..... 315/119, 315/127, 121, 307, 306, 225, 224, 291, DIG. 7
See application file for complete search history.

(56) References Cited

U.S. PATENT DOCUMENTS 5,574,335 A * 11/1996 Sun ..... 315/119
5,635,799 A * 6/1997 Hesterman ..... 315/127
6,222,322 B1 * 4/2001 Stack ..... 315/119
6,501,225 B1 * 12/2002 Konopka ..... 315/105
6,781,326 B1 * 8/2004 Stack ..... 315/224

OTHER PUBLICATIONS

Michael Bairanzade, Efficient Safety Circuit For Electronic Ballast, Motorola Inc., Mar. 1998.*

* cited by examiner

*Primary Examiner*—Wilson Lee
*Assistant Examiner*—Ephrem Alemu

(57) ABSTRACT

Disclosed is a control circuit of an electronic ballast for a fluorescent lamp, wherein the control circuit comprises a protection circuit and an automatic re-lamp circuit. The protection circuit detects an abnormal voltage condition resulted from a defective lamp tube, stops an oscillation circuit of the electronic ballast from generating high voltage output, and thereby protects a worker from an electric shock when the worker attempts to replace the defective lamp tube. The automatic re-lamp circuit turns on a newly installed lamp tube without switching off and on a power supply to the fluorescent lamp first.

3 Claims, 1 Drawing Sheet

CONTROL CIRCUIT OF ELECTRONIC BALLAST FOR FLUORESCENT LAMP

FIELD OF THE INVENTION

The present invention relates to an electronic ballast for a fluorescent lamp, and more particularly, to a control circuit of an electronic ballast for a fluorescent lamp that provides abnormal voltage protection and automatic re-lamp functions.

BACKGROUND OF THE INVENTION

In recent years, electronic ballasts have been widely used for fluorescent lamps due to their smaller size, lighter weight, better efficiency from higher working frequency, and longer lifetimes of both the lamp tubes and the ballasts themselves.

In general, despite the many advantages of electronic ballasts, an internal circuit of an electronic ballast according to a prior art is easily affected by a variation of the ballast's operation load. In other words, when some operation characteristics of a fluorescent lamp tube change due to defective conditions, such as broken tube and gas leakage, the electronic ballast thereby starts to malfunction. In some cases, the electronic ballast is therefore burned out, or even goes into flames and causes a fire accident.

Moreover, when a defective lamp tube is taken down for replacement from a fluorescent lamp equipped with an electronic ballast according to a prior art, the electronic ballast does not stop generating high voltage output, which puts a worker replacing the defective tube under a great danger of electric shock.

When a defective lamp tube is taken down and a new or functional lamp tube is installed for a fluorescent lamp equipped with an electronic ballast according to a prior art, a supply voltage to the fluorescent lamp has to be switched off and on again in order to light the newly installed lamp tube. When the fluorescent lamp is in parallel connection with a large number of fluorescent lamps driven by a single power supply such as in a large hall, such a power interruption is undesirable.

SUMMARY OF THE INVENTION

Accordingly, the present invention is directed to a control circuit to be used along with an electronic ballast according to a prior art for a fluorescent lamp to eliminate the problems due to limitations and disadvantages of the related art.

An advantage of the present invention is to provide a control circuit that, when an abnormal high voltage due to a broken lamp tube, a gas leakage, and other problems occur on a fluorescent lamp, prevents an electronic ballast from burning out and minimizes the possibility of a fire accident.

Another advantage of the present invention is to provide a control circuit that, when an abnormal high voltage due to a broken lamp tube, a gas leakage and other problems occur on a fluorescent lamp, automatically stops an oscillation circuit in an electronic ballast to continue output a high voltage so that a defective lamp tube can be removed safely.

To achieve these advantages, a control circuit according to the present invention includes a protection circuit and an automatic re-lamp circuit. The protection circuit detects an abnormal high alternating current (AC) voltage at an output terminal of an electronic ballast and brings down an input direct current (DC) voltage to an oscillation circuit of the electronic ballast. The oscillation circuit thereby stops its oscillation and the electronic ballast ceases to output an AC voltage. On the other hand, the automatic re-lamp circuit starts the oscillation circuit of the electronic ballast and therefore the newly installed lamp tube is lighted automatically when a new or functional lamp tube is installed.

It is to be understood that both the foregoing general description and the following detailed description are exemplary and explanatory and are intended to provide further explanation of the present invention as claimed.

BRIEF DESCRIPTION OF THE DRAWINGS

The accompanying drawing, which is included to provide a further understanding of the present invention and are incorporated in and constitute a part of this specification, illustrates an embodiment of the present invention and together with the description serve to explain the principles of the present invention.

DETAILED DESCRIPTION OF THE PREFERRED EMBODIMENT

Figure 1:
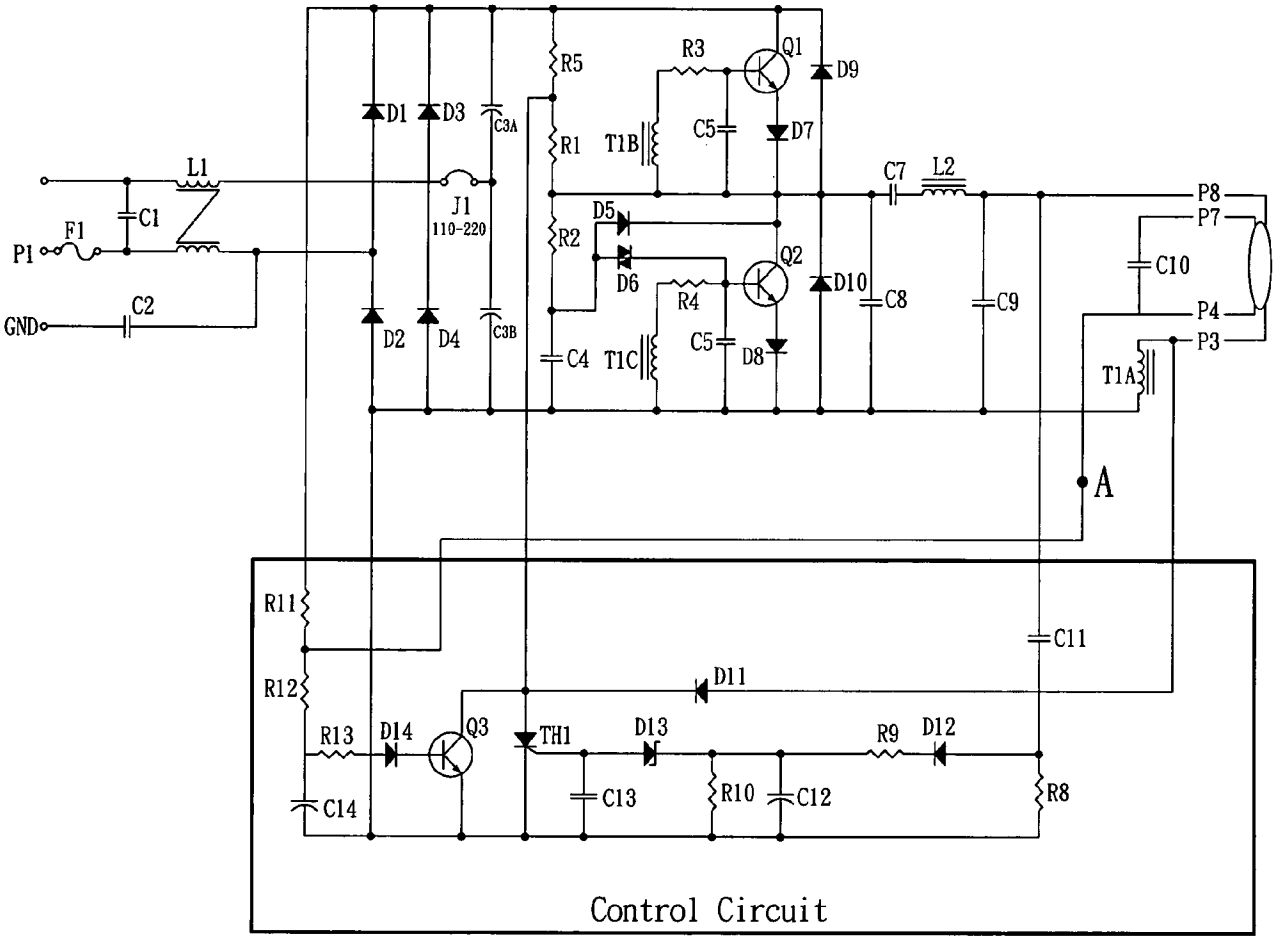
FIG. 1 is a circuit diagram showing an input power supply, an electronic ballast, a fluorescent lamp tube, and a control circuit according to an embodiment of the present invention.

To disclose in details the objectives, characteristics, and features of the present invention, an embodiment of the present invention along with the accompanying drawing will be described in the following.

A control circuit according to the present invention is structured along with an electronic ballast according to a prior art and controls an operation of the electronic ballast.

FIG. 1 is a circuit diagram showing an input power supply, an electronic ballast, a fluorescent lamp tube, and a control circuit according to an embodiment of the present invention. As shown in FIG. 1, the control circuit is marked inside a rectangle box. Outside the box are circuits of an input power supply, an electronic ballast and a lamp tube. The control circuit includes a protection circuit and an automatic re-lamp circuit.

The protection circuit connects an output terminal P8 of the electronic ballast to a ground via a capacitor C11 and a resistor R8 in a series connection. A junction between the capacitor C11 and resistor R8 is connected to an anode of a diode D12. A cathode of the diode D12 is then connected to a resistor R9 that in turn is connected to the ground via a capacitor C12. The resistor R9 and capacitor C12 forms an integrator circuit. The capacitor C12 is in a parallel connection with a resistor R10. The resistor R10, capacitor C12, and resistor R9 are all connected to a cathode of a Zener diode D13. An anode of the Zener diode D13 is connected to the ground via a capacitor C13 and to a gate of a SCR thyristor TH1. A cathode of the SCR thyristor TH1 is connected to the ground. On the other hand, an anode of the SCR thyristor TH1 is connected to a junction between a resistor R5 and a resistor R1 inside the electronic ballast and a cathode of a diode D11. An anode of the diode D11 is connected to a terminal P3 of a primary winding T1A of a driving transformer of the electronic ballast. As shown in FIG. 1. the output terminal P8 provides a high voltage to a first filament of the fluorescent lamp in the normal operation. The first filament is also connected to an output terminal P7. Another two output terminals P3 and P4 of the electronic ballast are connected to a second filament. The two output terminals P7 and P4 are connected by a capacitor C10.

The automatic re-lamp circuit connects a direct current (DC) voltage positive output terminal of a filtered and rectified input alternating current (AC) power supply to a resistor R11. The resistor R11 is connected to the ground via a series connection of a resistor R12 and a capacitor C14. A junction of the resistor R11 and resistor R12 is connected to a terminal P4 of a fluorescent lamp tube's filaments via a line A. A resistor R13 connects a junction of the resistor R12 and capacitor C14 to an anode of diode D14. A cathode of the diode D14 is connected to a base of a transistor Q3. An emitter of the transistor Q3 is connected to the ground. A collector of the transistor Q3 is connected to the anode of the SCR thyristor TH1 within the protection circuit.

An operation procedure of an embodiment of the present invention as illustrated in FIG. 1 is described as follows.

When a lamp tube of a fluorescent lamp becomes defective such as the lamp tube is broken, the lamp tube has a gas leakage, etc., the lamp tube cannot be lighted and cannot function as a normal operation load to an electronic ballast of the fluorescent lamp. Thus, an abnormal high AC voltage is generated at an output terminal P8 of the electronic ballast. The abnormal high voltage not only can put a worker under a great danger of electric shock, but also can damage the electronic ballast easily.

The aforementioned protection circuit functions as follows. The abnormal high AC voltage at the terminal P8 is coupled to the diode D12 via the capacitor C11. The AC voltage is rectified by the diode D12 into a DC voltage and the DC voltage is applied to the Zener diode D13. When the DC voltage exceeds a working voltage Vz of the Zener diode D13, the Zener diode D13 is turned on and the DC voltage is applied to the gate of the SCR thyristor TH1. The SCR thyristor TH1 therefore enters an ON state and brings down an input voltage to the electronic ballast to a low level at the junction between the resistor R5 and resistor R1. The SCR thyristor TH1 is latched and remains in the ON state until the defective lamp tube is replaced.

On the other hand, the driving transformer T1 (not shown in FIG. 1) of the electronic ballast has its primary winding T1A series-connected to a filament of the lamp tube and its two secondary windings T1B and T1C connected to bases of transistors Q1 and Q2 respectively. The transistors Q1 and Q2 form a half-bridge oscillation circuit inside the electronic ballast. Under a normal operating condition, T1B and T1C make the transistors Q1 and Q2 to continue oscillating and therefore generate a high voltage output. When the SCR thyristor TH1 inside the protection circuit is turned on, the terminal P3 at an end of the T1A is grounded via the diode D11 and the SCR thyristor TH1. The half-bridge oscillation circuit therefore stops functioning.

Due to the foregoing two scenarios, the oscillation circuit of the electronic ballast stops oscillating and thereby ceases to generate an abnormal high AC voltage.

In addition, the capacitor C12 and resistor R9 forms an integrator circuit whose major function is to detect whether the aforementioned high voltage coupled via the capacitor C11 is normal or not. If the DC voltage rectified by the diode D12 has a delay time less than 1 second after going through the capacitor C12 and resistor R9, the aforementioned high voltage is considered to be a normal transient voltage pulse used to light the lamp tube. With an appropriate selection of the capacitor C12 and resistor R9, the transient voltage pulse will not trigger the SCR thyristor TH1. On the other hand, if the DC voltage rectified by the diode D12 has a delay time greater than 2 seconds after going through the capacitor C12 and resistor R9, an accumulated voltage due to an integral effect from the capacitor C12 and resistor R9 will pass through the Zener diode D13 and therefore turn on the SCR thyristor TH1. Besides, a major function of the capacitor C13 is to prevent an interference from high frequency noises.

The aforementioned automatic re-lamp circuit functions as follows. The DC voltage obtained from filtering and rectifying an input AC power supply affects a base bias of the transistor Q3 via the resistor R11, R12, capacitor C14, and diode D14.

Under a normal condition with a functional lamp tube, a low-impedance path is formed from the line A, lamp tube filaments P4 and P3, the primary winding T1A of the driving transformer, and then to the ground. The low-impedance path brings down a DC voltage at the junction of the resistor R11 and R12 to a low level such that a base bias of the transistor Q3 cannot turn on the transistor Q3.

When the lamp tube becomes defective such as the lamp tube is broken, the lamp tube has a gas leakage, etc., an abnormal high voltage is generated at the output terminal P8 of the electronic ballast. The high voltage goes through the capacitor C11, resistor R8, diodes D12, Zener diode D13, and then triggers the SCR thyristor TH1. After the SCR thyristor TH1 is turned on, there is almost no electric current flow through the primary winding T1A of the driving transformer. The oscillation circuit of the electronic ballast stops oscillating and thereby the protective function of the control circuit is achieved. The transistor Q3 is still not turned on up to now.

When the defective lamp tube is removed, the low-impedance path including the line A becomes a high-impedance path and the transistor Q3 obtains a base bias through the resistor R11, R12, R13, and diode D14, that is high enough to turn the transistor Q3 on. As the transistor Q3 is in a parallel connection with the SCR thyristor TH1, the transistor Q3's being turned on is equivalent to shorting the anode and cathode of the SCR thyristor TH1. The SCR thyristor TH1 is therefore reset and returns to an OFF state. The oscillation circuit of the electronic ballast still cannot oscillate and generate high voltage output.

When a functional lamp tube is installed, the path including the line A, filaments P3 and P4, the primary winding T1A of the driving transformer and the ground becomes a low-impedance path again. The low-impedance path brings down a DC voltage at the junction of the resistor R11 and R12 to a low level such that a base bias of the transistor Q3 cannot turn on the transistor Q3. The terminal P3 is not connected to the ground as the transistor Q3 is not turned on and the SCR thyristor TH1 is reset to an OFF state. An electric current begins to flow through the primary winding T1A of the driving transformer and the oscillation circuit of the electronic ballast is started to light the lamp tube. The fluorescent lamp now returns to the normal condition as described earlier.

A major function of the capacitor C14 is that, under a normal lighting condition, an AC voltage from the line A is by-passed to the ground via the capacitor C14 so that the transistor Q3's normal operation is not affected.

It will be apparent to those skilled in the art that various modifications and variations can be made in the fabrication and application of the present invention without departing from the spirit or scope of the invention. Thus, it is intended that the present invention cover the modifications and variations of this invention provided they come within the scope of the appended claims and their equivalents.

What is claimed is:

1. A control circuit of an electronic ballast for a fluorescent lamp which comprises a first filament with two ends connected to output terminals P7 and P8 of the electronic ballast, and a second filament with two ends connected to output terminals P3 and P4 of the electronic ballast, the electronic ballast comprising a capacitor C10 connected between the output terminals P7 and P4, a filter and rectifier circuit providing a DC voltage positive output and a ground, a half bridge oscillation circuit mainly formed by two transistors Q1 and Q2 for generating a high voltage output to the output terminal P8, and a driving transformer with a primary winding T1A and two secondary windings T1B and T1C, the primary winding T1A having a first end connected to the output terminal P3 and a second end connected to the ground, the secondary winding T1B having a first end driving the transistor Q1 and a second end connected to a resistor R1 which is connected to the DC voltage positive output through a resistor R5, the secondary winding T1C having a first end driving the transistor Q2 and a second end connected to the ground, the control circuit comprising:

a protection circuit for preventing the half bridge oscillation circuit of the electronic ballast from generating an abnormal high AC voltage when the fluorescent lamp is defective, the protection circuit including a capacitor C11 having a first end connected to the output terminal P8 and a second end connected to an anode of a diode D12 and a resistor R8 which is connected to the ground, a resistor R9 having a first end connected to a cathode of the diode D12 and a second end connected to a cathode of a Zener diode D13, a capacitor C12 in parallel with a resistor R10 connecting the cathode of the Zener diode D13 to the ground, a capacitor C13 connecting an anode of the Zener diode D13 to the ground, a SCR thyristor TH1 having a gate connected to the anode of the Zener diode D13, a cathode connected to the ground and an anode connected to a junction between the resistor R1 and the resistor R5, and a diode D11 having an anode connected to the output terminal P3 and a cathode connected to the anode of the SCR thyristor TH1; and an automatic re-lamp circuit for lighting a newly-installed fluorescent lamp without switching off and on a supplying power of the control circuit, the automatic re-lamp circuit including a resistor R11 having a first end connected to the DC voltage positive output and a second end connected to the output terminal P4, a resistor R12 having a first end connected to the output terminal P4 and a second end connected to the ground via a capacitor C14, a transistor Q3 having a collector connected to the anode of the SCR thyristor TH1, an emitter connected to the ground and a base connected to a cathode of a diode D14, and a resistor R13 connecting the second end of the resistor R12 to an anode of the diode D14.

2. The control circuit as claimed in claim 1, wherein the capacitor C13 of the protection circuit is to prevent interference from high frequency noises.

3. The control circuit as claimed in claim 1, wherein the capacitor C14 is to provide a by-pass so that an AC voltage from a filament is by-passed to the ground to avoid affecting the normal operation of the transistor Q3 under a normal lighting condition.

* * * * *